United States Patent [19]

Brandestini et al.

[11] 3,956,797

[45] May 18, 1976

[54] ANCHORAGE BODY FOR ANCHORING TENDONS WITH WEDGES

[75] Inventors: Antonio Brandestini, Küsnacht; Hans-Rudolf Siegwart, Kilchberg; Gerard Welbergen, Zurich, all of Switzerland

[73] Assignee: Antonio Brandestini, Zurich, Switzerland

[22] Filed: Mar. 29, 1972

[21] Appl. No.: 239,024

Related U.S. Application Data

[63] Continuation-in-part of Ser. No. 20,614, March 18, 1970.

[52] U.S. Cl. ..... 24/126; 52/230; 425/111

[51] Int. Cl.[2] ..... F16G 11/00

[58] Field of Search ..... 24/126 R, 122.3; 52/123, 223 L; 249/83; 425/111

[56] References Cited

UNITED STATES PATENTS

| | | | |
|---|---|---|---|
| 2,250,440 | 7/1941 | Shannon | 21/126 R |
| 2,616,139 | 11/1952 | Wald | 24/126 R |
| 2,728,978 | 1/1956 | Birkenmaier et al. | 52/230 X |
| 3,137,971 | 6/1964 | Rhodes | 52/230 |
| 3,163,904 | 1/1965 | Ziolkowski | 25/118 T |
| 3,184,219 | 5/1965 | Simms | 254/29 A |
| 3,221,572 | 12/1965 | Swick | 285/162 |
| 3,241,204 | 3/1966 | Baricevic et al. | 24/126 R |
| 3,293,811 | 12/1966 | Rice | 52/223 L |
| 3,359,528 | 12/1967 | Scholz | 24/126 R |
| 3,399,434 | 9/1968 | Kelly | 24/126 R |
| 3,524,228 | 8/1970 | Kelly | 24/126 R |
| 3,596,330 | 8/1971 | Scott | 24/122.3 |
| 3,614,052 | 10/1971 | Babbage | 249/43 |
| 3,833,706 | 9/1974 | Edwards | 425/111 |
| 3,844,697 | 10/1974 | Edwards | 425/111 |

*Primary Examiner*—Robert L. Wolfe
*Assistant Examiner*—Victor N. Sakran
*Attorney, Agent, or Firm*—Richard P. Alberi

[57] ABSTRACT

In an anchorage for tendons, such as strands, an anchorage body for anchoring tendons with wedges, having a central passage or bore for the tendon, at least one part or section of which passage widening conically from the inlet end to the outlet end in order to form a seat for wedges, said anchorage body presenting at the inlet end of said passage a projection integral with the remaining part of the body and having also a passage or bore for the tendon to form a holding means for a sealing element surrounding the portion of a tendon near the anchoring body.

6 Claims, 6 Drawing Figures

ANCHORAGE BODY FOR ANCHORING TENDONS WITH WEDGES

This application is a continuation-in-part of our copending application, Ser. No. 20.614, filed Mar. 18, 1970.

The present invention relates to an anchorage body for anchoring tendons with wedges, such as strands. Known anchorage bodies for anchoring tendons with wedges have a central passage for tendon, at least one section of which passage widening conically from the inlet end to the outlet end in order to form a seat for wedges.

Such anchorage bodies for tendons, known in various forms, do not fulfill all conditions as end anchorages inserted in the formwork or shuttering.

The main disadvantage of such known anchorage bodies resides in the fact that the inlet opening in the anchorage body is not adequately sealed, this leading to the wedge seats being fouled by grout, etc.

The present invention has for its objects to provide an improved anchorage body which contributes to avoid the disadvantages of the known devices.

The anchorage body according to the invention is characterized in that, it comprises a central passage for the tendon, at least one section of said passage widening conically from the inlet end to the outlet end in order to form a seat for said wedges; an axial extension integral with said inlet end, said passage for said tendon continuing through said axial extension; means on said body to which a holding and sealing sleeve can be removably secured; and a holding and sealing sleeve coaxially and removably fixed on said body, provided with a passage for the tendon and having rigid wedge retaining means extending in a direction from the outlet end to said wedge seat section of the body and terminating at a distance smaller than the length of the wedges from said seat.

It often arrives that tendons are not properly centered, so that the anchoring with wedges becomes problematic.

It is therefore a further object of the present invention to provide an anchorage obviating both of the aforementioned drawbacks.

To this end an anchorage body is provided having a central passage for the tendon, at least one section of which passage widening conically from the inlet end to the outlet end in order to form a seat for wedges and presenting a projection at the inlet end of said passage, said projection forming a part integral with the remaining anchorage body and having also a passage for the tendon, the first section of the passage in said projection tapering conically in order to form a seat for a centering- and sealing-element to be inserted between tendon and anchorage body.

The invention will be better understood, and objects other than those set forth above will become apparent, when consideration is given to the following detailed description thereof. Such description makes reference to the annexed drawings wherein generally the same reference numerals or characters have usually been employed to denote the same or or analogous elements, and wherein.

Figure 1:
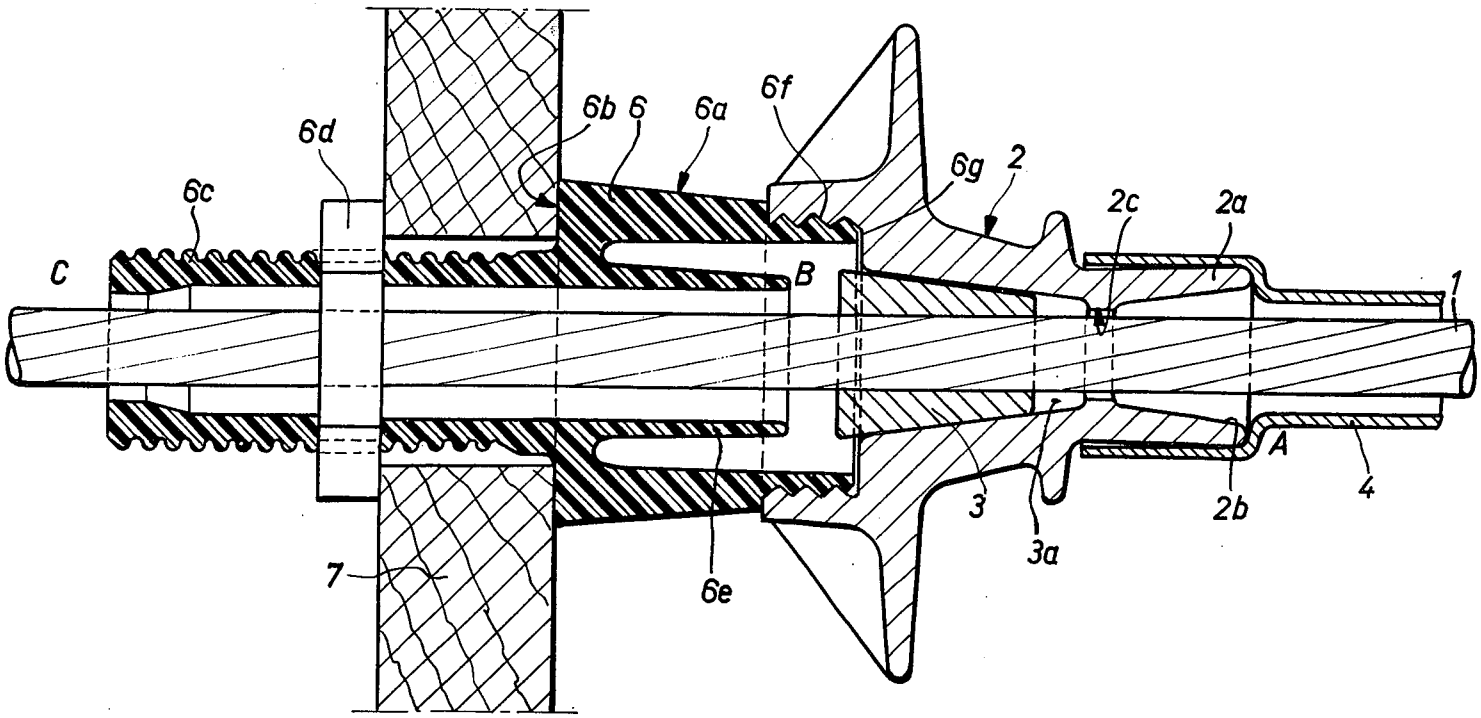
FIG. 1 shows a longitudinal section through an end anchorage by means of an anchorage body according to the invention.

When placing the tendon 1 and the end anchorages in a shuttering, the following must particularly be heeded:

a. Care must be taken that no grout can penetrate into the conical space 3*a* which will later receive the wedges 3, either on the front side B of the anchorage body or above all on the later inaccessible rear side A thereof.

Furthermore, the following conditions should if possible also be heeded:

b. The tendon 1 (together with sheathing 1*a*) should be exactly centered at the inlet point A in the anchorage body, so that when the tendon is later stressed, this centering remains true.

c. The anchorage body 2 must be fixable in the correct position, immovable with respect to the shuttering or formwork 7, so that, during concreting, the position of the anchorage body remains unaltered and said shuttering or formwork may easily be removed after the concrete has hardened.

In the embodiments shown, conditions (a) and (b) are fulfilled (FIGS. 1–5), in that the anchorage body section 2 has on its rear side A a tubular extension 2*a* internally provided with a conical recess 2*b*, which tapers in direction B. After the tendon 1, which may be enveloped in a paper sheathing, has been inserted, a tubular sealing body 4 is coupled to the tubular extension 2*a*. A centering of the tendon 1 takes place at 2*c* of the tubular extension 2a and a seal against the penetration of grout is obtained by the sealing body 4 and by the holding and sealing sleeve 6 removably fixed to body 2 after insertion of the wedges 3. The inner diameter of the constriction 2*c* must however be some-what larger than the outer diameter of the tendon, since it must be possible to push said tendon through this constriction without difficulty. Particularly when using strands as tendons, considerable thickenings are often formed at the ends thereof due to cutting by means of cutting torches, which thickenings must be guided through the constriction 2*c*. A centering of the tendon directly by means of this constriction is therefore often omitted, for practical reasons. FIG. 3 shows another possibility for centering the tendon 1.

Figure 2:
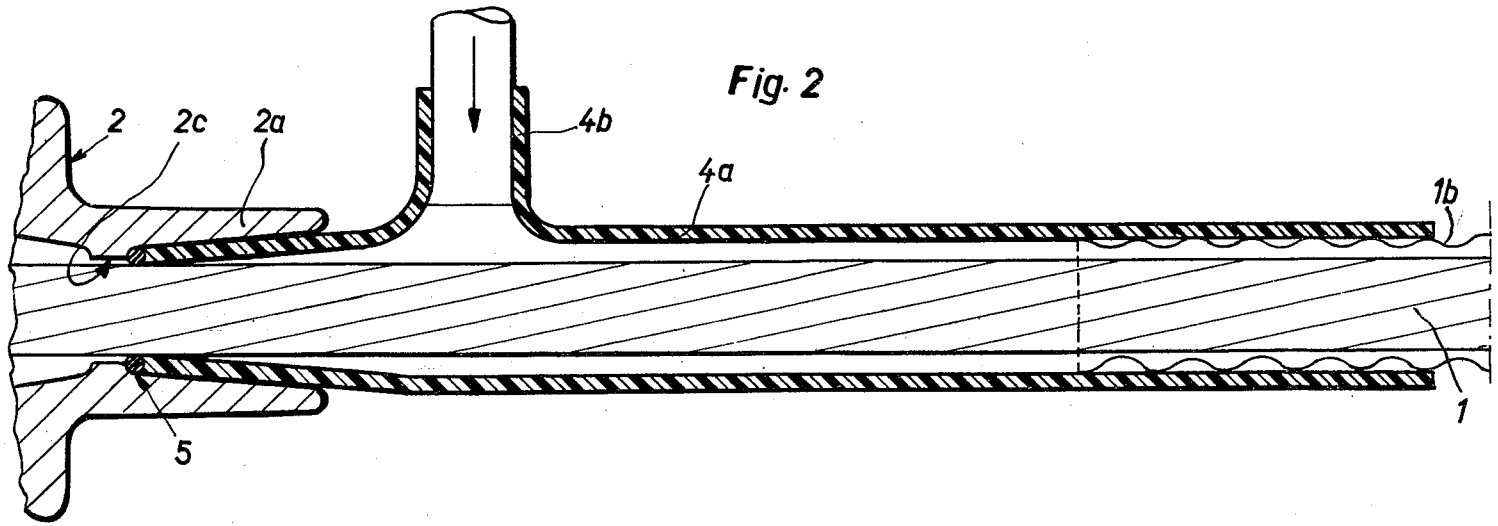
FIG. 2 shows a longitudinal section through the inlet section of a similar anchorage.
Figure 3:
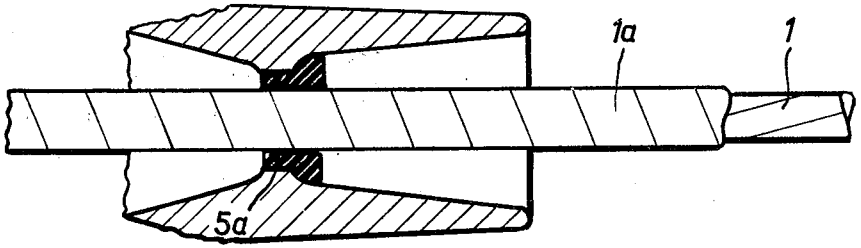
FIG. 3 shows a section through the inlet opening of a further embodiment of an anchorage.

The sealing body 4 shown in FIG. 2 may be composed of rubber, plastic material or even metal; it may be provided with a longitudinal slit at least at one place over at least a certain length. Especially when using a sealing body composed of metal, the seal at the centering point can be additionally reinforced by the interposition of a sealing ring 5 made of soft material. On the other hand, when using a sealing body 4 composed of comparatively soft material, a ring 5*a* consisting for example of two parts may be placed on the constriction 2*c* as centering means (FIG. 3), before the seal 4 is pressed in. The sealing body 4 may be of any desired length. FIG. 1 shows by way of example a sealing body coupled to the outer side of the extension 2a; the tendon here consists of a strand with a lubricating and rust-protection coating. The tendon may however also pass through a rigid conduit (e.g. metal hose) 1*b* (FIG. 2), the space between tendon and sheathing being grouted after stressing. The seal 4*a* between the conduit and the anchorage body 2, 2*a* may in this case be constructed as shown in FIG. 2, and it may also take over the function of a connecting piece, i.e. may be provided with another inlet opening 4*b* for the connection of the pipe for the grout.

The sealing body 4 may also be additionally glued to the conical inner face 2*b*. This inner face may have a rough surface for better adhesion.

Condition (c) is also fulfilled by the present invention. To this end, the anchorage body 2 is securely connected (for example by screwing) to a holding and sealing sleeve 6 (FIG. 1). The shuttering or formwork 7 is for its part securely connected to the holding sleeve 6 by being pressed against the shoulder 6*b* of the holding sleeve 6 by means of the nut 6*d*. It is important that the holding sleeve 6 is not only securely, but also tightly connected to the anchorage body 2. It is shown that when using a suitable plastic material, a multiple thread 6*f* is sufficient for the seal against grout penetrating into the wedge space 3a. In order to increase the seal, the teeth of the thread or the surface 6b and 6g may be provided with thin fins which are pressed together when the holding sleeve 6 is screwed in and thereby improve the seal.

Sleeve 6 is provided with wedge retaining means in form of an inner tubular extension 6*e* forming an integral part of the sleeve 6 and projection in direction of the wedges 3. In operation the wedges are first inserted and the sleeve 6 is mounted thereafter. There is a distance between the end of the extension 6*e* and the wedge seat, this distance being smaller than the length of the wedges.

After the concrete has hardened, the holding sleeve 6 is removed, this being simplified by the cone 6*a*.

Figure 4:
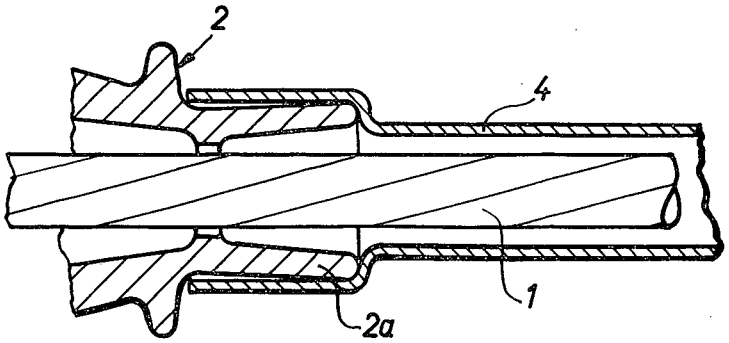
FIGS. 4 to 6 show longitudinal sections through the inlet portion of similar anchorages.

FIG. 4 shows the inlet portion of an anchoring body 2 in which the sealing shell 4 surrounding the tendon 1 sits on the outer surface of the extension 2*a*. The sealing shell 4 may be secured on the extension by means of any suitable mechanical means or by by an adhesive. In the anchorage shown in FIG. 4 no centering element is provided for tendon 1.

Figure 5:
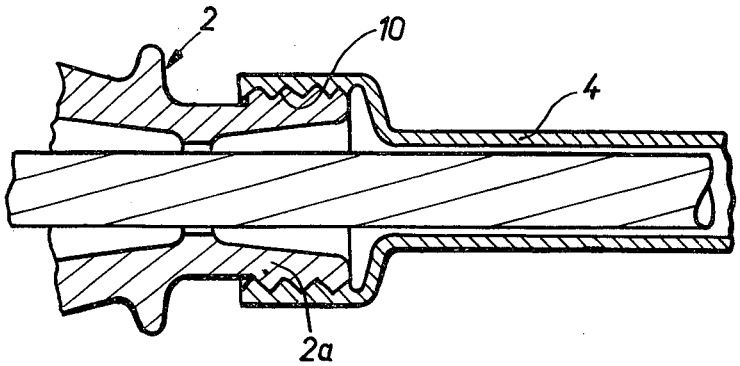

FIG. 5 shows an anchorage similar to that of FIG. 4 with the only difference that the outer surface of the extension 2*a* of the anchorage body 2 is provided with a thread for threading thereon the sealing shell 4.

Figure 6:
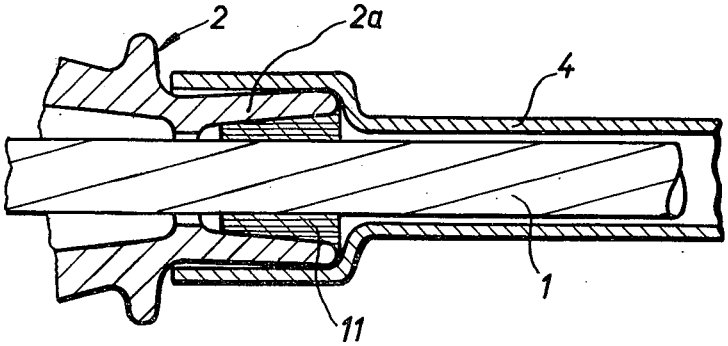

FIG. 6 finally shows part of an anchorage in which the sealing shell 4 bears against the outer surface of the extension 2*a* of the anchorage body, whilst a centering means, e.g. a two-part centering cone 11, is provided between the tendon 1 and the wall of the conically inwardly tapering passage 2*b* of the extension 2*a*.

What we claim is:

1. An anchoring device for anchoring tendons with wedges, comprising:

an anchor body having a central passage therein for receiving said tendon, said passage having an inlet end and an outlet end, an outlet section of said passage widening conically toward said outlet end to form a seat for said wedges, and an inlet section of said passage widening conically toward said inlet end;

attachment means adjacent said outlet end; and a one-piece holding and sealing sleeve coaxially and removably fixed to said attachment means on said anchor body for holding said anchor body to a fixed support, said holding sleeve having a central passage for said tendon and having a rigid wedge retaining means providing an abutting surface axially spaced from said outlet section a distance less than the length of said wedges for trapping said wedges within said outlet section, said holding and sealing sleeve having an inside diameter at its end coupled to said anchor body greater than the diameter of the passage forming said wedge seat, and said wedge retaining means comprises an inner tubular portion within the inside diameter of said holding and sealing sleeve integrally joined to the portion of said holding and sealing sleeve adjacent the fixed support and extending in the direction of said wedge seat to form said abutting surface.

2. An anchoring device for anchoring tendons with wedges, comprising:

an anchor body having a central passage therein for receiving said tendon, said passage having an inlet end and an outlet end, an outlet section of said passage widening conically toward said outlet end to form a seat for said wedges, and an inlet section of said passage widening conically toward said inlet end;

a sealing shell coupled to said inlet section;

a centering means between the inside surface of said inlet section and said tendon for centering said tendon in said passage;

attachment means adjacent said outlet end; and a one-piece holding and sealing sleeve coaxially and removably fixed to said attachment means on said anchor body for holding said anchor body to a fixed support, said holding sleeve having a central passage for said tendon and having a rigid wedge retaining means providing an abutting surface axially spaced from said outlet section a distance less than the length of said wedges for trapping said wedges within said outlet section, said holding and sealing sleeve having an inside diameter at its end coupled to said anchor body greater than the diameter of the passage forming said wedge seat, and said wedge retaining means comprises an inner tubular portion within the inside diameter of said holding and sealing sleeve integrally joined to the portion of said holding and sealing sleeve adjacent the fixed support and extending in the direction of said wedge seat to form said abutting surface.

3. The anchorage device as claimed in claim 2, wherein said inlet section is a tubular extension of said anchorage body, the outer surface of said tubular extension forming a seat for attaching said sealing shell.

4. The anchorage device as claimed in claim 2, wherein said inside surface of said inlet section tapers conically inwardly from said inlet end to form a seat for separate centering means.

5. The anchorage device as claimed in claim 4, including a shoulder-like local constriction between said conically tapering and said conically widening sections of said passage, whereby said constriction serves as a stop for said separate centering means.

6. The anchorage device as claimed in claim 5, wherein said sealing shell includes a shoulder adjacent the end of said separate centering means opposite the end stopped by said separate constriction, for confining said centering means within said inlet section between said constriction and said shoulder.

* * * * *

UNITED STATES PATENT OFFICE

CERTIFICATE OF CORRECTION

Patent No. 3,956,797 Dated May 18, 1976

Inventor(s) Antonio Brandestini et al.

It is certified that error appears in the above-identified patent and that said Letters Patent are hereby corrected as shown below:

On the Cover Sheet, Item /30/ should read:

Switzerland 4611/69 March 26, 1969

Signed and Sealed this

Twenty-third Day of November 1976

[SEAL]

*Attest:*

RUTH C. MASON
*Attesting Officer*

C. MARSHALL DANN
*Commissioner of Patents and Trademarks*